US008980516B2

(12) United States Patent
Kikushima

(10) Patent No.: US 8,980,516 B2
(45) Date of Patent: Mar. 17, 2015

(54) ELECTROSTATIC CHARGE IMAGE DEVELOPMENT TONER

(71) Applicant: Kyocera Document Solutions Inc., Osaka (JP)

(72) Inventor: Seiji Kikushima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/141,315

(22) Filed: Dec. 26, 2013

(65) Prior Publication Data

US 2014/0186759 A1 Jul. 3, 2014

(30) Foreign Application Priority Data

Dec. 27, 2012 (JP) ..... 2012-285757

(51) Int. Cl.
*G03G 9/093* (2006.01)
*G03G 9/087* (2006.01)

(52) U.S. Cl.
CPC ..... *G03G 9/09364* (2013.01); *G03G 9/08711* (2013.01); *G03G 9/08768* (2013.01); *G03G 9/08791* (2013.01); *G03G 9/08797* (2013.01); *G03G 9/09392* (2013.01); *G03G 9/09321* (2013.01)
USPC ..... 430/110.1; 430/110.2

(58) Field of Classification Search
USPC ..... 430/110.1, 110.2
See application file for complete search history.

(56) References Cited

U.S. PATENT DOCUMENTS 8,394,565 B2 3/2013 Sensui
2010/0173240 A1 7/2010 Sensui

FOREIGN PATENT DOCUMENTS

WO 2007/114502 A1 10/2007

*Primary Examiner* — Hoa V Le
(74) *Attorney, Agent, or Firm* — Studebaker & Brackett PC

(57) ABSTRACT

An electrostatic charge image development toner contains a plurality of toner particles. The plurality of toner particles are each formed to have resin particulates in a surface layer. The resin particulates each include a particulate core and a coating layer covering the particulate core. The particulate core contains a quaternary ammonium salt functional group-containing resin. The coating layer contains one or more resins selected from the group consisting of (meth)acrylic resins and styrene-(meth)acrylic resins.

9 Claims, No Drawings

ELECTROSTATIC CHARGE IMAGE DEVELOPMENT TONER

INCORPORATION BY REFERENCE

The present application claims priority under 35 U.S.C. §119 to Japanese Patent Application No. 2012-285757, filed Dec. 27, 2012. The contents of this application are incorporated herein by reference in their entirety.

BACKGROUND

The present disclosure relates to electrostatic charge image development toners.

In a typical electrophotographic technique, the surface of an electrostatic latent image bearing member is charged by using corona discharge etc., an electrostatic latent image is then formed by exposure using a laser etc., the electrostatic latent image is then developed by using toner to form a toner image, and the toner image is then transferred to a recording medium, resulting in a high-quality image. Toner suitable for such an electrophotography technique typically is a toner containing toner particles having an average particle size of at least 5 μm and not more than 10 μm which is produced by mixing an essential component (a binder resin), such as a thermoplastic resin, and an optional component(s) (a colorant, a charge control agent, a release agent, or a magnetic material) followed by kneading, pulverization, and classification. Such a process including kneading the components of toner, pulverizing the kneaded mixture, and classifying the pulverized matter is called a "pulverization method." An inorganic fine powder, such as silica or titanium oxide, may be attached as an external additive to the toner particles in order to impart flowability to the toner, control charge on the toner particles, or improve the removability of the toner particles.

It is desirable that such toner have good fixability at low temperature in order to achieve energy saving or equipment downsizing. The toner having good fixability at low temperature can be satisfactorily fixed by using a fixing roller without heating the fixing roller as much as possible. However, the toner having good fixability at low temperature often contains a binder resin having a low melting point and a low glass transition point and a release agent having a low melting point. In general, when such toner is stored at high temperature, the toner particles are likely to aggregate. When the toner particles aggregate, the aggregated toner particles have charge characteristics different from those of the toner particles which are not aggregated. In this case, the aggregated toner particles may adhere to a portion which is not related to an output image, resulting in color dots occurring on a fixed output image, which is a problem.

On the other hand, an electrostatic latent image bearing member (photosensitive member) which includes a photosensitive layer of amorphous silicon, which has a high hardness, is often employed in order to reduce an environmental impact. Such a photosensitive member including the photosensitive layer having a high hardness can be used for a very long time. The photosensitive member including the photosensitive layer of amorphous silicon is used in combination with positively chargeable toner. Therefore, when the photosensitive member including the photosensitive layer of amorphous silicon is used, a compound having a positively chargeable functional group, such as a quaternary ammonium salt functional group, is typically added to toner in order to ensure that the toner will be positively charged with stability.

As such a toner, the following toner has been proposed. An external additive, which is hydrophobized with an amino group-containing compound, is attached to the surface of a toner particle which is produced by melting aggregated particulates of binder resin particulates and colorant particulates to stick together by heating. The toner particle also contains a charge control agent, such as a polymer containing a quaternary ammonium salt functional group-containing acrylate unit.

SUMMARY

The present disclosure relates to an electrostatic charge image development toner. An electrostatic charge image development toner of the present disclosure contains a plurality of toner particles. The plurality of toner particles are each formed to have resin particulates in a surface layer. The resin particulates each include a particulate core and a coating layer covering the particulate core. The particulate core contains a quaternary ammonium salt functional group-containing resin. The coating layer contains one or more resins selected from the group consisting of (meth)acrylic resins and styrene-(meth)acrylic resins.

DETAILED DESCRIPTION

Embodiments of the present disclosure will now be described in detail. The present disclosure is not intended to be limited to the embodiments set forth herein, but on the contrary, it is intended to cover such alternatives, modifications, and equivalents as can be reasonably included within the spirit and scope of the present disclosure. Note that the same or like parts may not be redundantly described, but this is not intended to limit the subject matter of the present disclosure.

An electrostatic charge image development toner (hereinafter also simply referred to as a "toner") of the present disclosure contains a plurality of toner particles. The plurality of toner particles are each formed to have resin particulates in a surface layer. The resin particulates each include a particulate core and a coating layer covering the particulate core. The particulate core contains a quaternary ammonium salt functional group-containing resin. The coating layer contains one or more resins selected from the group consisting of (meth) acrylic resins and styrene-(meth)acrylic resins. The basic backbone of the quaternary ammonium salt functional group-containing resin contained in the particulate core may be a (meth)acrylic resin or a styrene-(meth)acrylic resin. However, as used herein, the terms "(meth)acrylic resin" and "styrene-(meth)acrylic resin" without the modifying phrase "quaternary ammonium salt functional group-containing" or the like do not include a quaternary ammonium salt functional group-containing (meth)acrylic resin or a quaternary ammonium salt functional group-containing styrene-(meth)acrylic resin.

A toner of the present disclosure may include toner particles whose surfaces are treated with an external additive. As used herein, the term "toner mother particle" refers to a particle which is to be treated with an external additive. As used herein, the term "toner particle" refers to a particle corresponding to a "toner mother particle" no matter whether the toner contains an external additive.

As described above, the toner particle of the present disclosure is made from resin particulates each including a particulate core and a coating layer covering a surface of the particulate core. The toner of the present disclosure may have a core-shell structure as described below. As used herein, the term "particulate core" refers to a central particle of a resin particulate which is a constituent of a toner particle. As used herein, the term "coating layer" refers to a layer which covers a particulate core. As used herein, the terms "toner core" and "shell layer" with respect to a toner having a core-shell structure refer to a central particle of a toner particle and a layer covering the toner core, respectively.

The toner of the present disclosure may, for example, be a core-shell toner having a core-shell structure which includes a toner core and a shell layer which is a surface layer of a toner particle to cover the toner core. Another example of the toner of the present disclosure may be, for example, a non-core-shell toner which does not include a shell layer on the surface of the toner core. A toner particle in the non-core-shell toner is obtained by melting and kneading toner components, such as a binder resin and a colorant or by causing particulates containing toner components, such as a binder resin and a colorant, to aggregate and then coalescing the particulates together by heating. The toner of the present disclosure may be optionally blended with a carrier and used as a two-component developer. As examples of the toner of the present disclosure, a core-shell toner, a non-core-shell toner, and a two-component developer will now be described.

<<Core-Shell Toner>>

As described above, the core-shell toner has a core-shell structure including a toner core and a shell layer covering the toner core. The shell layer included in the core-shell toner is made from resin particulates each of which includes a particulate core containing a quaternary ammonium salt functional group-containing resin and covered by a coating layer. The coating layer is made from a material containing one or more resins selected from the group consisting of (meth) acrylic resins and styrene-(meth)acrylic resins.

The toner core included in the core-shell toner contains an essential component (a binder resin) and any optional component(s) (a release agent, a colorant, a charge control agent, and a magnetic powder) as required, in the mixing state. Regarding the core-shell toner, the following now describes the toner core, the shell layer, and methods for producing the core-shell toner.

[Toner Core]

The toner core contains an essential component (a binder resin). The toner core may contain any optional component(s) (a colorant, a charge control agent, a release agent, and a magnetic powder) in addition to the essential component (a binder resin) as required. The essential component (a binder resin) and any optional component(s) (a colorant, a release agent, a charge control agent, and a magnetic powder) of the toner core will now be described.

(Binder Resin)

The binder resin contained in the toner core is not particularly limited and may be any binder resin for toner. Examples of the binder resin include thermoplastic resins, such as styrene-based resins, acrylic resins, styrene-(meth)acrylic resins, polyethylene-based resin, polypropylene-based resins, vinyl chloride-based resins, polyester resins, polyamide resins, polyurethane resins, polyvinyl alcohol-based resin, vinyl ether-based resins, N-vinyl-based resins, and styrene-butadiene resins. Of these resins, styrene-(meth)acrylic resins and polyester resins are preferable in terms of the dispersibility of the colorant in the toner, the chargeability of the toner, and the ability of the toner to be fixed to paper. Styrene-(meth)acrylic resins and polyester resins will now be described.

Styrene-(meth)acrylic resins are copolymers of a styrene-based monomer and a (meth)acrylic monomer. Examples of the styrene-based monomer include styrene, α-methylstyrene, vinyl toluene, α-chlorostyrene, o-chlorostyrene, m-chlorostyrene, p-chlorostyrene, and p-ethylstyrene. Examples of the (meth)acrylic monomer include alkyl (meth) acrylate esters, such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

Examples of the polyester resins include polyester resins obtained by condensation polymerization or condensation copolymerization of a dihydric or tri- or higher-hydric alcohol component and a dicarboxylic or tri- or higher-carboxylic acid component. Examples of components which are used in synthesis of polyester resins include dihydric or tri- or higher-hydric alcohol components and dicarboxylic or tri- or higher-carboxylic acid components as follows.

Examples of the dihydric or tri- or higher-hydric alcohol components include diols, such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; bisphenols, such as bisphenol A, hydrogenated bisphenol A, polyoxyethylenated bisphenol A, and polyoxypropylenated bisphenol A; and trihydric or higher-hydric alcohols, such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of the dicarboxylic or tri- or higher-carboxylic acid components include dicarboxylic acids, such as maleic acid, fumaric acid, citraconic acid, itaconic acid, glutaconic acid, phthalic acid, isophthalic acid, terephthalic acid, cyclohexanedicarboxylic acid, succinic acid, alkyl or alkenyl succinic acids (n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid), adipic acid, sebacic acid, azelaic acid, and malonic acid; and tricarboxylic or higher-carboxylic acids, such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and Empol trimer acid. These dicarboxylic or tri- or higher-carboxylic acid components may be used as ester-forming derivatives, such as acid halides, acid anhydrides, and lower alkyl esters. As used herein, the term "lower alkyl" refers to an alkyl group having 1-6 carbon atoms.

As the binder resin, thermoplastic resins may be preferably used because of its good ability to allow the toner to be fixed to paper. In addition, not only a thermoplastic resin may be used alone as the binder resin, but also a crosslinking agent or a thermosetting resin may be added to the thermoplastic resin. By introducing a crosslinked structure into a portion of the binder resin, properties of the toner, such as preservability, form retaining ability, and durability, can be improved without a decrease in the ability to allow the toner to be fixed to paper.

Examples of the thermosetting resin which may be used along with the thermoplastic resin include epoxy resins and cyanate resins. Examples of a suitable thermosetting resin include bisphenol A type epoxy resins, hydrogenated bisphenol A type epoxy resins, novolac type epoxy resins, polyalkylene ether type epoxy resins, cycloaliphatic type epoxy resins, and cyanate resins. Two or more of these thermosetting resins may be used in combination.

The softening point (Tm) of the binder resin is not particularly limited. Typically, the softening point (Tm) of the binder resin is preferably at least 60° C. and not more than 100° C., more preferably at least 70° C. and not more than 95° C. If the softening point (Tm) of the binder resin is too high, the adhesion of the toner to a development sleeve is reduced or prevented, but it may be difficult for the toner to be satisfactory fixed at low temperature. On the other hand, if the softening point (Tm) of the binder resin is too low, the toner may adhere to a development sleeve, or the heat-resistant preservability of the toner may be impaired. The softening point (Tm) of the binder resin may be measured by using a method described below.

The glass transition point ($Tg_1$) of the binder resin is preferably at least 50° C. and not more than 65° C., more preferably at least 50° C. and not more than 60° C. If the glass transition point ($Tg_1$) of the binder resin is too low, toner particles may be melted to stick together in a development unit of an image forming apparatus, or toner particles may be partially melted to stick together due to a decrease in preservability during transportation of a toner container and storage of a toner container in a warehouse. On the other hand, if the glass transition point ($Tg_1$) of the binder resin is too high, the strength of the binder resin decreases, and therefore, the toner may be likely to adhere to a latent image bearing unit (an image bearing member, i.e., a photosensitive member). Also, if the glass transition point ($Tg_1$) of the binder resin is too high, it may be difficult for the toner to be satisfactorily fixed at low temperature.

(Release Agent)

The toner core may optionally contain a release agent. The release agent is typically used to improve the low temperature fixability and offset resistance of the toner. The release agent is not specifically limited and may be any release agent that is traditionally used for toner.

Examples of a suitable release agent include aliphatic hydrocarbon waxes, such as low molecular weight polyethylene, low molecular weight polypropylene, polyolefin copolymers, polyolefin waxes, microcrystalline waxes, paraffin waxes, and Fischer-Tropsch waxes; oxides of aliphatic hydrocarbon waxes, such as oxidized polyethylene waxes, and block copolymers of oxidized polyethylene waxes; plant waxes, such as candelilla wax, carnauba wax, Japan wax, jojoba wax, and rice wax; animal waxes, such as beeswax, lanolin, and spermaceti; mineral waxes, such as ozokerite, ceresin, and petrolatum; waxes containing a fatty acid ester as a major component, such as montanic acid ester wax and castor wax; and waxes containing partially or fully deoxidized fatty acid esters, such as deoxidized carnauba wax.

The amount of the release agent which is contained in the binder resin is preferably at least 1 part by mass and not more than 30 parts by mass with respect to 100 parts by mass of the binder resin, more preferably at least 5 parts by mass and not more than 20 parts by mass. If the amount of the release agent is too small, a satisfactory effect of suppressing the occurrence of offset and smearing in the formed image may not be achieved. On the other hand, if the amount of the release agent is too large, toner particles may be melted to stick together, leading to a decrease in the preservability of the toner.

(Colorant)

The toner core may optionally contain a colorant. As a colorant contained in the toner core, known pigments and dyes may be used which are suitable for the intended color of the toner particle. Specific examples of a suitable colorant which can be contained in the toner core are described as follows.

An example of a black colorant is carbon black. Alternatively, as a black colorant, a colorant may be used whose color is adjusted to black by using colorants, such as a yellow colorant, a magenta colorant, and a cyan colorant described below. If the toner particle is of color toner, colorants blended in the toner core may be, for example, a yellow colorant, a magenta colorant, and a cyan colorant.

Examples of the yellow colorant include condensed azo compounds, isoindolinone compounds, anthraquinone compounds, azo-metal complexes, methine compounds, and allylamide compounds. Specific examples of the yellow colorant include C.I. pigment yellows (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), naphthol yellow S, Hansa yellow G, and C.I. Vat yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of the magenta colorant include C.I. pigment reds (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of the cyan colorant include copper phthalocyanine compounds, copper phthalocyanine derivatives, anthraquinone compounds, and basic dye lake compounds. Specific examples of the cyan colorant include C.I. pigment blues (1, 7, 15, 15:1, 15:2, 15:3, 15:4, 60, 62, and 66), phthalocyanine blue, C.I. Vat blue, and C.I. acid blue.

The amount of a colorant(s) which is contained in the toner core is preferably at least 1 part by mass and not more than 20 parts by mass with respect to 100 parts by mass of the binder resin, more preferably at least 3 parts by mass and not more than 10 parts by mass.

(Charge Control Agent)

The toner core may optionally contain a charge control agent. The charge control agent is used to improve the stability of the charge level of the toner or the charge rise characteristics of the toner which indicate whether or not the toner can be quickly charged to a predetermined charge level, thereby imparting good durability and stability to the toner. In the toner of the present disclosure, the toner particle is formed to have resin particulates in the surface layer, and each resin particulate includes a particulate core containing a quaternary ammonium salt functional group-containing resin and a coating layer containing one or more resins selected from the group consisting of (meth)acrylic resins and styrene-(meth) acrylic resins. Therefore, the toner of the present disclosure is used as positively chargeable toner. Therefore, as the charge control agent, a positively chargeable charge control agent is used.

Examples of the positively chargeable charge control agent include azine compounds, such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes made from an azine compound, such as azine fast red FC, azine fast red 12BK, azine violet BO, azine brown 3G, azine light brown GR, azine dark green BH/C, azine deep black EW, and azine deep black 3RL;

nigrosine compounds, such as nigrosine, nigrosine salts, and nigrosine derivatives; acid dyes made from a nigrosine compound, such as nigrosine BK, nigrosine NB, and nigrosine Z; metal salts of naphthenic acids or higher fatty acids; alkoxylated amines; alkylamides; and quaternary ammonium salts, such as benzylmethylhexyldecyl ammonium and decyl trimethyl ammonium chloride. Two or more of these positively chargeable charge control agents may be used in combination.

For example, resins having a quaternary ammonium salt, a carboxylic acid salt, or a carboxyl group as a functional group may also be used as the positively chargeable charge control agent. Examples of resins having such a functional group include styrene-based resins having a quaternary ammonium salt, acrylic resins having a quaternary ammonium salt, styrene-acrylic resins having a quaternary ammonium salt, polyester resins having a quaternary ammonium salt, styrene-based resins having a carboxylic acid salt, acrylic resins having a carboxylic acid salt, styrene-acrylic resins having a carboxylic acid salt, polyester resins having a carboxylic acid salt, styrene-based resins having a carboxyl group, acrylic resins having a carboxyl group, styrene-acrylic resins having a carboxyl group, and polyester resins having a carboxyl group. The molecular weights of these resins may be oligomeric or polymeric.

The amount of the positively chargeable charge control agent which is contained in the toner is typically at least 0.5 parts by mass and not more than 5 parts by mass with respect to the total mass of the toner taken as 100 parts by mass, more preferably at least 1 part by mass and not more than 3 parts by mass. If the amount of the charge control agent is too small, it is difficult for the toner to be charged to a predetermined polarity, and therefore, the image density of a formed image may exceed a desired value and become unnecessarily high, leading to a decrease in image quality, or fogging may occur in a formed image. On the other hand, if the amount of the charge control agent is too large, the amount of charge may be too large at low temperature and low humidity, and therefore, the image density of a formed image may be lower than a desired value.

(Magnetic Powder)

The toner core may optionally contain a magnetic powder. Examples of a suitable magnetic powder include iron, such as ferrite and magnetite; ferromagnetic metals, such as cobalt and nickel; alloys containing iron and/or a ferromagnetic metal; compounds containing iron and/or a ferromagnetic metal; ferromagnetic alloys subjected to a treatment of imparting ferromagnetism thereto, such as a thermal treatment; and chromium dioxide.

The magnetic powder preferably has a particle size of at least 0.1 μm and not more than 1.0 μm, more preferably at least 0.1 μm and not more than 0.5 μm. When a magnetic powder having a particle size within such a range is used, the magnetic powder can be easily uniformly dispersed in the binder resin.

When the electrostatic charge image development toner is used as a one-component developer, the amount of the magnetic powder which is contained in the toner is preferably at least 35 parts by mass and not more than 60 parts by mass with respect to 100 parts by mass of the toner, more preferably at least 40 parts by mass and not more than 60 parts by mass. If the amount of the magnetic powder is too large, then when image formation is performed over a long time period, it may be difficult to maintain the desired image density of a formed image or the fixability may extremely decrease. On the other hand, if the amount of the magnetic powder is too small, fogging is likely to occur in a formed image, and therefore, it may be difficult to maintain the desired image density of a formed image over a long time period. When the toner is used as a two-component developer, the amount of the magnetic powder which is used in the toner is preferably not more than 5 parts by mass with respect to the total mass of the toner taken as 100 parts by mass, more preferably not more than 3 parts by mass.

[Shell Layer]

In the core-shell toner of the present disclosure, the surface of the toner core is covered by a shell layer which is the surface layer of the toner particle. The shell layer is made from resin particulates each including a particulate core containing a quaternary ammonium salt functional group-containing resin and covered by a coating layer of a material containing a particular resin which does not have a chargeable functional group. Regarding the resin particulates forming the shell layer, the following now particularly describes the particulate core, the coating layer, and a method for producing the resin particulate.

(Resin Particulates)

(Particulate Core)

The quaternary ammonium salt functional group-containing resin contained in the particulate core is not particularly limited and may be any resin having a quaternary ammonium salt functional group. The quaternary ammonium salt functional group-containing resin is preferably a (meth)acrylic resin having a quaternary ammonium salt functional group or a styrene-(meth)acrylic resin having a quaternary ammonium salt functional group because a toner having good heat-resistant preservability can be easily obtained. Two or more quaternary ammonium salt functional group-containing resins may be used in combination. The (meth)acrylic resin having a quaternary ammonium salt functional group and the styrene-(meth)acrylic resin having a quaternary ammonium salt functional group will now be described.

((Meth)Acrylic Resin Having Quaternary Ammonium Salt Functional Group)

A method for preparing the (meth)acrylic resin having a quaternary ammonium salt functional group is not particularly limited. The (meth)acrylic resin having a quaternary ammonium salt functional group may be, for example, prepared by using the following methods: monomers including a monomer having a quaternary ammonium salt functional group and a (meth)acrylic monomer are polymerized; monomers including a monomer having a quaternary ammonium group and a (meth)acrylic monomer are polymerized, and thereafter, the quaternary ammonium group in the resultant resin is converted into a quaternary ammonium salt functional group; and monomers including a monomer having a tertiary amino group and a (meth)acrylic monomer are polymerized, and thereafter, the tertiary amino group is converted into a quaternary ammonium salt functional group.

Of these methods, the method of polymerizing monomers including a monomer having a quaternary ammonium salt functional group and a (meth)acrylic monomer is preferable because the desired resin can be easily obtained. The monomers used in this method will now be described.

The monomer having a quaternary ammonium salt functional group may be prepared by converting the tertiary amino group of the monomer having a tertiary amino group into a quaternary ammonium salt functional group. Examples of the monomer having a tertiary amino group include dialkylaminoalkyl(meth)acrylates, dialkylamino(meth)acrylamides, and dialkylaminoalkyl(meth)acrylamides. Examples of the dialkylaminoalkyl(meth)acrylates include dimethylaminoethyl(meth)acrylate, diethylaminoethyl(meth)acrylate, dipropylaminoethyl(meth)acrylate, and dibutylaminoethyl(meth)

acrylate. Examples of the dialkyl(meth)acrylamides include dimethylmethacrylamide. Examples of the dialkylaminoalkyl(meth)acrylamides include dimethylaminopropylmethacrylamide.

Examples of a reagent which is used to convert a tertiary amino group into a quaternary amino group include halogenated alkyls having 1-6 carbon atoms, such as methyl chloride, methyl bromide, and ethyl chloride; sulfuric esters, alkyl esters having 1-6 carbon atoms, such as dimethyl sulfate, diethyl sulfate, methyl benzenesulfonate, and methyl p-toluenesulfonate; and halogenated aralkyls having 7-10 carbon atoms, such as benzyl chloride.

Examples of a (meth)acrylic monomer which is used in preparation of the (meth)acrylic resin having a quaternary ammonium salt functional group include (meth)acrylates; alkyl(meth)acrylates, such as methyl(meth)acrylate, ethyl (meth)acrylate, and propyl(meth)acrylate; and (meth)acrylamide compounds, such as (meth)acrylamides, N-alkyl(meth) acrylamides, N-aryl(meth)acrylamides, N,N-dialkyl(meth) acrylamides, and N,N-diaryl(meth)acrylamides.

Examples of monomers other than the monomer having a quaternary ammonium salt functional group and the (meth) acrylic monomer, which are used in preparation of the (meth) acrylic resin having a quaternary ammonium salt functional group, include olefins, such as ethylene, propylene, butene-1, penten-1, hexene-1, heptene-1, and octene-1; allyl esters, such as allyl acetate, allyl benzoate, allyl acetoacetate, and allyl lactate; vinyl ethers, such as hexylvinyl ether, octylvinyl ether, ethylhexyl vinyl ether, methoxyethyl vinyl ether, ethoxyethyl vinyl ether, chloroethyl vinyl ether, 2-ethylbutyl vinyl ether, dimethylaminoethyl vinyl ether, diethylaminoethyl vinyl ether, benzyl vinyl ether, vinyl phenyl ether, vinyl tolyl ether, vinyl chlorophenyl ether, vinyl-2,4-dichlorophenyl ether, and vinyl naphthyl ether; vinyl esters, such as vinyl acetate, vinyl propionate, vinyl butyrate, vinyl isobutyrate, vinyl diethyl acetate, vinyl chloroacetate, vinyl methoxy acetate, vinyl butoxy acetate, vinyl phenyl acetate, vinyl acetoacetate, vinyl lactate, vinyl benzoate, vinyl salicylate, vinyl, chlorobenzoate, and vinyl naphthoate.

The monomer having a quaternary ammonium salt functional group, the (meth)acrylic monomer, and another optional monomer(s), which are described above, are polymerized by using a known method to obtain the (meth)acrylic resin having a quaternary ammonium salt functional group.

The content of a unit derived from the (meth)acrylic monomer which is contained in the (meth)acrylic resin having a quaternary ammonium salt functional group is preferably at least 45% by mass with respect to the mass of the quaternary ammonium salt functional group-containing resin, more preferably at least 55% by mass, and particularly preferably at least 65% by mass. Note that if the unit having a quaternary ammonium salt functional group is a (meth)acrylic unit having a quaternary ammonium salt functional group, the (meth) acrylic unit having a quaternary ammonium salt functional group is also considered as the unit derived from the (meth) acrylic monomer.

(Styrene-(Meth)Acrylic Resin Having Quaternary Ammonium Salt Functional Group)

The styrene-(meth)acrylic resin having a quaternary ammonium salt functional group may be prepared in the same manner in which the (meth)acrylic resin having a quaternary ammonium salt functional group is prepared, except for further copolymerization of a styrene-based monomer.

Examples of a styrene-based monomer which is used in preparation of the styrene-(meth)acrylic resin include styrene, α-methylstyrene, o-methylstyrene, m-methylstyrene, p-methylstyrene, p-ethylstyrene, 2,4-dimethyl styrene, p-n-butylstyrene, p-dodecylstyrene, p-methoxystyrene, p-phenylstyrene, and p-chlorostyrene.

The total content of a unit derived from the styrene-based monomer and a unit derived from the (meth)acrylic monomer which are contained in the styrene-(meth)acrylic resin having a quaternary ammonium salt functional group, is preferably at least 45% by mass with respect to the mass of the quaternary ammonium salt functional group-containing resin, more preferably at least 55% by mass, and particularly preferably at least 65% by mass. Note that if the unit having a quaternary ammonium salt functional group is a (meth)acrylic unit having a quaternary ammonium salt functional group, the (meth) acrylic unit having a quaternary ammonium salt functional group is considered as the unit derived from the (meth)acrylic monomer.

The molar ratio of the unit having a quaternary ammonium salt functional group to all units included in the quaternary ammonium salt functional group-containing resin is preferably at least 5 mol % and not more than 35 mol %. If the molar ratio of the unit having a quaternary ammonium salt functional group is within such a range, the toner is readily allowed to be quickly charged to a desired charge level, and even when the toner is stirred in the development unit for a long time, the toner can be satisfactorily charged to a desired charge amount.

The melting point of the quaternary ammonium salt functional group-containing resin is preferably at least 80° C. and not more than 150° C., more preferably at least 90° C. and not more than 140° C., and particularly preferably at least 100° C. and not more than 130° C. If the melting point of the quaternary ammonium salt functional group-containing resin is too high, it may be difficult for the toner to be satisfactorily fixed at low temperature. On the other hand, if the melting point of the quaternary ammonium salt functional group-containing resin is too low, the heat-resistant preservability of the toner may be impaired. The melting point of the quaternary ammonium salt functional group-containing resin may be measured by using a method similar to the above-described method of measuring the softening point (Tm) of the binder resin.

The glass transition point ($Tg_2$) of the quaternary ammonium salt functional group-containing resin is preferably at least 40° C. and not more than 80° C., more preferably at least 50° C. and not more than 70° C., and particularly preferably at least 55° C. and not more than 65° C. If the glass transition point ($Tg_2$) of the quaternary ammonium salt functional group-containing resin is too low, the toner particles may aggregate under environmental conditions of high temperature and high humidity. On the other hand, if the glass transition point ($Tg_2$) of the quaternary ammonium salt functional group-containing resin is too high, it may be difficult for the toner to be satisfactorily fixed at low temperature. The glass transition point ($Tg_2$) of the quaternary ammonium salt functional group-containing resin may be measured by using a method similar to the above-described method of measuring the glass transition point ($Tg_1$) of the binder resin.

The materials for the particulate core may include another resin in addition to the quaternary ammonium salt functional group-containing resin. Examples of a resin which may be contained in the particulate core in addition to the quaternary ammonium salt functional group-containing resin, include resins similar to the above-described resins suitable as the binder resin. The content of the quaternary ammonium salt functional group-containing resin in the materials for the particulate core is preferably at least 70% by mass, more preferably at least 80% by mass, particularly preferably at least 90% by mass, and most preferably 100% by mass.

(Coating Layer)

The coating layer is made from materials including one or more resins selected from the group consisting of (meth) acrylic resins and styrene-(meth)acrylic resins. The (meth) acrylic resins and the styrene-(meth)acrylic resins are the same as the (meth)acrylic resins having a quaternary ammonium salt functional group and the styrene-(meth)acrylic resins having a quaternary ammonium salt functional group, except that the unit having a quaternary ammonium salt functional group is not included.

The content of a unit derived from a (meth)acrylic monomer which is contained in the (meth)acrylic resin is preferably at least 80% by mass with respect to the mass of the (meth)acrylic resin, more preferably at least 90% by mass, and particularly preferably 100% by mass. The total content of a unit derived from a styrene-based monomer and a unit derived from a (meth)acrylic monomer which are contained in the styrene-(meth)acrylic resin, is preferably at least 80% by mass with respect to the mass of the styrene-(meth)acrylic resin, more preferably at least 90% by mass, and particularly preferably 100% by mass.

The coating layer may contain another resin(s) in addition to the (meth)acrylic resin and the styrene-(meth)acrylic resin. Examples of a resin which may be contained in the coating layer in addition to the (meth)acrylic resin and the styrene-(meth)acrylic resin, include resins similar to the above-described resins suitable as the binder resin. The content of the resin(s) selected from (meth)acrylic resins and styrene-(meth)acrylic resins, which is one of the materials for the coating layer, is preferably at least 70% by mass with respect to the mass of the coating layer, more preferably at least 80% by mass, particularly preferably at least 90% by mass, and most preferably 100% by mass.

The mass of the coating layer is preferably at least 30 parts by mass and not more than 70 parts by mass with respect to 100 parts by mass of the particulate core, more preferably at least 40 parts by mass and not more than 60 parts by mass.

(Method for Producing Resin Particulates)

The method used to produce resin particulates is not particularly limited and may be any method in which the particulate core containing the quaternary ammonium salt functional group-containing resin can be satisfactorily covered by the coating layer containing a resin selected from (meth) acrylic resins and/or styrene-(meth)acrylic resins. For example, the resin particulates are produced as follows. A monomer component(s) for forming a (meth)acrylic resin and/or a styrene-(meth)acrylic resin is added to an aqueous medium in which the particulate cores containing the quaternary ammonium salt functional group-containing resin are dispersed. Thereafter, the monomer component is polymerized in the aqueous medium by using a known method to form a coating layer on the surface of the particulate core. The monomer component for forming a (meth)acrylic resin and/or a styrene-(meth)acrylic resin may be added to the aqueous medium in which the particulate cores are dispersed, all at once or sequentially.

An example of a suitable method of dispersing the particulate cores containing the quaternary ammonium salt functional group-containing resin in the aqueous medium is the following. Initially, the quaternary ammonium salt functional group-containing resin prepared by using a known method is roughly pulverized by using a pulverization device. The roughly pulverized matter is dispersed in an aqueous medium, such as ion-exchanged water. The resultant dispersion liquid of the roughly pulverized matter is heated to a temperature which is higher by at least 10° C. than the melting point of the quaternary ammonium salt functional group-containing resin. Note that the melting point of the quaternary ammonium salt functional group-containing resin may be measured by using a flow tester. A great shear force is applied to the heated dispersion liquid of the quaternary ammonium salt functional group-containing resin by using a high-speed shear emulsification device, such as CLEARMIX (manufactured by M Technique Co., Ltd.), whereby an aqueous medium dispersion liquid containing the particulate cores containing the quaternary ammonium salt functional group-containing resin is obtained.

A surfactant is preferably added to the aqueous medium dispersion liquid containing the particulate cores so that the particulate cores are satisfactorily dispersed in the aqueous medium. If a surfactant is added to the aqueous medium dispersion liquid containing the particulate cores, the surfactant is preferably a cationic surfactant because the particulate cores contain the positively chargeable quaternary ammonium salt functional group-containing resin.

Examples of the cationic surfactant include dodecylammonium chloride, dodecylammonium bromide, dodecyltrimethylammonium bromide, dodecylpyridinium chloride, dodecylpyridinium bromide, and hexadecyltrimethylammonium bromide.

The aqueous medium dispersion liquid containing the resin particulates which have been produced in the aqueous medium may be used directly in a method for producing an electrostatic charge image development toner described below.

The volume average particle size ($D_{50}$) of the resin particulates is preferably at least 0.03 μm and not more than 0.50 μm, more preferably at least 0.05 μm and not more than 0.30 μm. If the volume average particle size of the resin particulates covering the surface of the toner core is within such a range, the surface of the toner core is easily uniformly covered with the resin particulates. The volume average particle size ($D_{50}$) of the resin particulates may be measured by using an electrophoretic light scattering photometer ("LA-950V2" manufactured by HORIBA, Ltd.).

[Method for Producing Core-Shell Toner]

The core-shell toner may be, for example, produced as follows. The toner core is dispersed in an aqueous medium, and the resin particulates are then caused to adhere to the surface of the toner core. Next, the resin particulates on the surface of the toner core are heated to form a film, thereby forming a shell layer on the surface of the toner core. A method for producing the toner core is not particularly limited. An example of a suitable method for producing the toner core is a "pulverization method" in which the components of the toner core, such as a binder resin or a colorant, are mixed, the mixture is then melted and kneaded, and the resultant melt and kneaded matter is pulverized, followed by classification, thereby forming particles having the desired particle size. The toner core may be, for example, preferably produced by using the following "aggregation method." Particulates containing the components of the toner core, such as a binder resin or a colorant, are caused to aggregate, and the aggregated bodies of the particulates are then coalesced together by heating. Of these methods, the "aggregation method" is more preferable because the toner is easily caused to have a uniform particle size, and the toner core is easily blended with a large amount of release agent compared to the pulverization method. A method for producing the core-shell toner which includes a method for producing the toner core by using the aggregation method will now be described.

Specifically, the core-shell toner producing method includes the following steps (I)-(IV):

(I) an aqueous medium dispersion liquid (A) containing particulates containing the binder resin is prepared, and thereafter, the particulates containing the binder resin are allowed to aggregate in the presence of an aggregating agent, thereby obtaining an aqueous medium dispersion liquid (B) containing aggregated bodies of the particulates containing the binder resin;

(II) the aqueous medium dispersion liquid (B) containing the aggregated bodies of the particulates is heated to coalesce components contained in the aggregated bodies of the particulates together, thereby obtaining an aqueous medium dispersion liquid (1) containing the toner cores having the desired particle size;

(III) the aqueous medium dispersion liquid (1) adjusted to a pH of not more than 5, and an aqueous medium dispersion liquid (2) containing resin particulates, are mixed to provide an aqueous medium dispersion liquid (3) containing the toner cores and the resin particulates (mixing step);

(IV) the aqueous medium dispersion liquid (3) is adjusted to a pH of at least 6 and not more than 10, followed by heating, whereby the surface of the toner cores are covered with the resin particulates (covering step); and (V) the toner cores covered with the resin particulates are heated, whereby a layer of the resin particulates formed on the surface of the toner core is caused to form a film, i.e., a shell layer (shell layer forming step).

When a toner according to an embodiment of the present disclosure is produced, the following steps (VI)-(VIII) may be optionally included in addition to steps (I)-(V) described above:

(VI) the toner is washed (washing step);

(VII) the toner is dried (drying step); and (VIII) an external additive is attached to the surface of the toner mother particles (external additive attaching step).

Steps (I)-(VIII) will now be described.

(Step (I))

In step (I), the aqueous medium dispersion liquid (A) containing the particulates containing the binder resin is obtained. Thereafter, the particulates containing the binder resin are caused to aggregate in the presence of an aggregating agent, thereby obtaining the aqueous medium dispersion liquid (B) containing the aggregated bodies of the particulates containing the binder resin.

A method for preparing the aqueous medium dispersion liquid (A) containing the particulates containing the binder resin is not particularly limited. The particulates containing the binder resin may be particulates of a resin composition including an essential component, such as a binder resin, and any optional component(s) (a colorant, a release agent, or a charge control agent).

Typically, the particulates containing the binder resin are prepared as an aqueous medium dispersion liquid containing the particulates by forming the binder resin or a composition containing the binder resin into particulates having the desired size in an aqueous medium. The aqueous medium dispersion liquid containing the particulate may also contain particulates other than the particulates containing the binder resin. Examples of the particulates other than the particulates containing the binder resin include particulates containing a colorant, particulates containing a release agent, and particulates containing a colorant and a release agent. A method for preparing the particulates containing the binder resin, a method for preparing the particulates containing a colorant, and a method for preparing the particulates containing a release agent will now be described. Note that particulates containing a component different from those of the particulates described herein may be prepared by using one or more of the methods for preparing these particulates which are appropriately selected.

<Preparation of Particulates Containing Binder Resin>

Initially, a binder resin or a resin composition containing the binder resin and any optional component(s) that may be contained in the toner cores, is roughly pulverized by using a pulverization device. While the resultant matter roughly pulverized is dispersed in an aqueous medium, such as water, the aqueous medium is heated to a temperature (maximum temperature: about 200° C.) which is higher by at least 10° C. than the softening point (Tm) of the binder resin, which is measured by using a flow tester. A great shear force is applied to the heated binder resin dispersion liquid by using a high-speed shear emulsification device, such as CLEARMIX (manufactured by M Technique Co., Ltd.), thereby obtaining an aqueous medium dispersion liquid containing particulates containing the binder resin.

The volume average particle size ($D_{50}$) of the particulates containing the binder resin is preferably not more than 1 μm, more preferably at least 0.05 μm and not more than 0.5 μm. If the particle size of the particulates containing the binder resin is within such a range, toner which has a narrow toner particle-size distribution and a uniform shape can be easily obtained, leading to a reduction in variations in performance and productivity of the toner. The volume average particle size ($D_{50}$) of the particulates containing the binder resin may be measured by using a laser diffraction particle-size distribution measuring device ("SALD-2200" manufactured by Shimadzu Corporation).

The aqueous medium dispersion liquid containing the particulates containing the binder resin, and an aqueous medium dispersion liquid containing the particulates containing the colorant and an aqueous medium dispersion liquid containing the particulates containing the release agent which will be described below, may contain a surfactant so that dispersion liquid of the particulates is stabilized. Examples of the surfactant include anionic surfactants, cationic surfactants, and nonionic surfactants. Of these surfactants, anionic surfactants or nonionic surfactants is preferable, taking into consideration the dispersion stability of the particulates.

Examples of the anionic surfactants include sulfate surfactants, sulfonate surfactants, phosphate surfactants, and soaps. Examples of the cationic surfactants include dodecylammonium chloride, dodecyl ammonium bromide, dodecyltrimethylammonium bromide, dodecylpyridinium chloride, dodecylpyridinium bromide, and hexadecyltrimethylammonium bromide. Examples of the nonionic surfactants include polyethylene glycol surfactants and alkylphenol ethylene oxide adduct surfactants; and tri- or higher-hydric alcohol surfactants which are derivatives of tri- or higher-hydric alcohols, such as glycerin, sorbitol, and sorbitan. Two or more of these surfactants may be used alone or in combination.

The amount of the surfactant is preferably at least 0.5% by mass and not more than 5% by mass with respect to the mass of the binder resin or the composition containing the binder resin.

If the binder resin is a polyester resin or a styrene-(meth) acrylic resin, the binder resin may have a carboxyl group, which is an acidic group. Therefore, if the acidic group-containing binder resin is directly formed into particulates in the aqueous medium, the specific surface of the binder resin increases, and therefore, the pH of the aqueous medium may decrease to at least about 3 and not more than about 4 due to the influence of the acidic group exposed on the surface of the particulates containing the binder resin. If the pH of the aqueous medium is too low, it may be difficult to obtain the particulates containing the binder resin having the desired particle size, and then when the binder resin is a polyester resin, the polyester resin may be hydrolyzed.

In order to address such a problem, a basic substance may be added to the aqueous medium when the particulates containing the binder resin are prepared. The basic substance is not particularly limited and may be any basic substance that can reduce or prevent the above problem. Examples of the basic substance include alkali metal hydroxides, such as sodium hydroxide, potassium hydroxide, and lithium hydroxide; alkali metal carbonates, such as sodium carbonate and potassium carbonate; alkali metal hydrogencarbonates, such as sodium hydrogencarbonate and potassium hydrogencarbonate; and nitrogen-containing organic bases, such as N,N-dimethylethanolamine, N,N-diethylethanolamine, triethanolamine, tripropanolamine, tributhanolamine, triethylamine, n-propylamine, n-butylamine, isopropylamine, monomethanolamine, morpholine, methoxypropylamine, pyridine, and vinylpyridine.

<Preparation of Particulates Containing Colorant>

A colorant and an optional dispersing agent for the colorant are dispersed in an aqueous medium by using a known dispersing device, whereby particulates containing the colorant are obtained. The type of a surfactant as the dispersing agent is not particularly limited. For example, any of anionic surfactants, cationic surfactants, and nonionic surfactants may be used as the dispersing agent. The amount of a surfactant which is used as the dispersing agent is not particularly limited. The concentration of the surfactant is preferably at least the critical micelle concentration (CMC).

The dispersing device used in the dispersion process is not particularly limited. Examples of the dispersing device include pressure dispersing devices, such as an ultrasonic dispersing device, a mechanical homogenizer, a Manton-Gaulin homogenizer, and a pressure homogenizer; and medium dispersion devices, such as a sand grinder, a Getzmann mill, and a diamond fine mill.

The volume average particle size ($D_{50}$) of the particulates containing the colorant is preferably at least 0.05 μm and not more than 0.5 μm. The volume average particle size ($D_{50}$) of the particulates containing the colorant may be measured by using a method similar to that for the volume average particle size of the particulates containing the binder resin.

<Preparation of Particulates Containing Release Agent>

The release agent is previously roughly pulverized to an average particle size of not more than about 100 μm. The roughly pulverized release agent is added to an aqueous medium containing a surfactant to prepare a slurry. Next, the slurry is heated to a temperature which is equal or higher than the melting point of the release agent. A great shear force is applied to the heated slurry by using a homogenizer or a pressure discharge dispersing device to prepare a dispersion liquid containing particulates containing the release agent.

Most release agents typically have a melting point of not more than 100° C. In this case, the release agent may be heated to a temperature which is equal or higher than the melting point under the atmospheric pressure and formed into particulates by using a commonly used homogenizer. On the other hand, if the melting point of the release agent exceeds 100° C., the release agent may be formed into particulates by using a pressure-proof device.

The volume average particle size ($D_{50}$) of the particulates containing the release agent contained in the aqueous medium dispersion liquid is preferably not more than 1 μm, more preferably at least 0.1 μm and not more than 0.3 μm. If the volume average particle size ($D_{50}$) of the particulates containing the release agent is within such a range, a toner core in which the release agent is uniformly dispersed in the binder resin can be obtained. The volume average particle size ($D_{50}$) of the particulates containing the release agent may be measured by using a method similar to that for the volume average particle size ($D_{50}$) of the particulates containing the binder resin.

In order to produce the toner core containing the predetermined components, aqueous medium dispersion liquids containing the various particulates described above are appropriately combined to obtain the aqueous medium dispersion liquid (A) containing the particulates containing the binder resin. Thereafter, the particulates contained in the aqueous medium dispersion liquid (A) are caused to aggregate to obtain the aqueous medium dispersion liquid (B) containing aggregated bodies of the particulates containing the binder resin. The particulates may be caused to aggregate, for example, by the following suitable method. After the pH of the aqueous medium dispersion liquid (A) containing the particulates containing the binder resin is adjusted, an aggregating agent is added to the aqueous medium dispersion liquid (A). Next, the temperature of the aqueous medium dispersion liquid (A) is adjusted to a predetermined temperature to allow the particulates to aggregate.

The pH of the aqueous medium dispersion liquid (A) during addition of the aggregating agent is preferably not more than eight. The aggregating agent may be added all at once or sequentially.

Examples of the aggregating agent added to the aqueous medium dispersion liquid (A) include inorganic metal salts, inorganic ammonium salts, and divalent or more-valent metal complexes. Examples of the inorganic metal salts include metal salts, such as sodium sulfate, sodium chloride, calcium chloride, calcium nitrate, barium chloride, magnesium chloride, zinc chloride, aluminum chloride, and aluminum sulfate; and inorganic metal salt polymers, such as polyaluminum chloride and polyaluminum hydroxide. Examples of the inorganic ammonium salts include ammonium sulfate, ammonium chloride, and ammonium nitrate. Nitrogen-containing compounds, such as quaternary ammonium salt cationic surfactants and polyethylenimine, may be used as the aggregating agent.

As the aggregating agent, a divalent metal salt and a monovalent metal salt are preferably used. The aggregating agents may be used alone, or two or more of the aggregating agents may be used in combination. If two or more aggregating agents are used in combination, a divalent metal salt and a monovalent metal salt are preferably used in combination. A rate of aggregation of particulates by a divalent metal salt and a rate of aggregation of particulates by a monovalent metal salt are different. Therefore, if particulates of a divalent metal salt and particulates of a monovalent metal salt are used in combination, a narrow particle-size distribution of aggregated bodies of the particulates is easily obtained while an increase in the particle sizes of the resultant aggregated bodies of the particulates is reduced or prevented. The amount of the aggregating agent which is added to the aqueous medium dispersion liquid (A) is preferably at least 0.1% by mass and not more than 25% by mass with respect to the solid content of the aqueous medium dispersion liquid (A).

The aqueous medium dispersion liquid (A) is preferably heated to a temperature which is equal or higher than the glass transition point ($Tg_1$) of the binder resin and lower than the temperature higher than the glass transition point ($Tg_1$) by 10° C. If the aqueous medium dispersion liquid (A) containing the particulates containing the binder resin is heated to such a temperature range, the aggregation of the particulates contained in the aqueous medium dispersion liquid (A) is allowed to proceed satisfactorily.

When the aggregation proceeds to give a desired particle size to the aggregated bodies of the particulates, an aggregation terminating agent may be added to the aqueous medium dispersion liquid (A). Examples of the aggregation terminating agent include sodium chloride, potassium chloride, and magnesium chloride. Thus, the aqueous medium dispersion liquid (B) containing the aggregated bodies of the particulates can be obtained.

(Step (II))

In step (II), the aqueous medium dispersion liquid (B) containing the aggregated bodies of the particulates is heated to coalesce the components included in the aggregated bodies of the particulates together, thereby obtaining the aqueous medium dispersion liquid (1) containing the toner cores having the desired particle size.

The temperature of the aqueous medium dispersion liquid (B) during the coalescing is not particularly limited and may be any temperature at which the coalescing of the components contained in the aggregated bodies of the particulates can proceed satisfactorily. Typically, the aqueous medium dispersion liquid (B) is preferably heated to a temperature which is equal or higher than the temperature higher than the glass transition point ($Tg_1$) of the binder resin by 10° C. and not higher than the softening point (Tm) of the binder resin.

(Step (III))

In step (III), the aqueous medium dispersion liquid (1) containing the toner cores is adjusted to a pH of not more than five. If the pH of the aqueous medium dispersion liquid (1) containing the toner cores is not more than five, then when the aqueous medium dispersion liquid (1), and the aqueous medium dispersion liquid (2) containing resin particulates described below, are mixed, the resin particulates contained in the aqueous medium dispersion liquid (2) are easily satisfactorily dispersed in the aqueous medium.

If the pH of the aqueous medium dispersion liquid (1) exceeds five, the resin particulates are likely to aggregate one another in the aqueous medium, and therefore, it may be difficult to cover the surface of the toner cores by using the resin particulates in a desired state in step (V) described below. In this case, the release agent exudes from the surface of the toner particle, and therefore, the toner particles are likely to aggregate. Therefore, it is difficult to obtain toner having good preservability. If the toner particles aggregate one another, it is difficult for the toner to be quickly charged to a predetermined charge level, and therefore, a color dot and/or fogging are likely to occur in a formed image.

After the aqueous medium dispersion liquid (1) is adjusted to a pH of not more than five, the aqueous medium dispersion liquid (1), and the aqueous medium dispersion liquid (2) containing the resin particulates, are mixed to obtain the aqueous medium dispersion liquid (3) containing the toner cores and the resin particulates. As the aqueous medium dispersion liquid (2), the aqueous medium dispersion liquid containing the resin particulates which is prepared by using the above-described method for producing the resin particulates may be directly used.

The temperature at which the aqueous medium dispersion liquid (1) and the aqueous medium dispersion liquid (2) are mixed is preferably higher than the glass transition point ($Tg_3$) of the resin contained in the coating layer of the resin particulates and lower than the temperature higher than glass transition point ($Tg_3$) by 10° C. If the aqueous medium dispersion liquid (1) and the aqueous medium dispersion liquid (2) are mixed within such a temperature range, the toner cores and the resin particulates can be satisfactorily dispersed in the aqueous medium.

The aqueous medium dispersion liquid (1) and the aqueous medium dispersion liquid (2) are preferably mixed at a mixture ratio where the mass of the resin particulates contained in the aqueous medium dispersion liquid (2) is at least 25 parts by mass and not more than 50 parts by mass with respect to 100 parts by mass of the binder resin in the toner cores contained in the aqueous medium dispersion liquid (1).

(Step (IV))

In step (IV), after the aqueous medium dispersion liquid (3) is adjusted to a pH of at least 6 and not more than 10, the aqueous medium dispersion liquid (3) is heated to cover the surface of the toner core with the resin particulates. If the pH of the aqueous medium dispersion liquid (3) is within such a value range, in the following step (V) the process of causing the layer of the resin particulates covering the toner core to be a film is allowed to proceed satisfactorily.

(Step (V))

In step (V), the toner core covered with the resin particulates is heated to cause the layer of the resin particulates formed on the surface of the toner core to form a film, i.e., a shell layer. The temperature at which the aqueous medium dispersion liquid (3) is heated during the process of causing the layer of the resin particulates to form a film is not particularly limited and may be any temperature that allows that process to proceed satisfactory. In step (V), the temperature at which the aqueous medium dispersion liquid (3) is heated is preferably equal or higher than the temperature which is higher than the glass transition point ($Tg_2$) of the quaternary ammonium salt functional group-containing resin by 10° C. and lower than the temperature which is lower than the melting point of the binder resin by 10° C. If the temperature at which the aqueous medium dispersion liquid (3) is heated is within such a temperature range, the process of causing the layer of the resin particulates covering the toner core to form a film is allowed to proceed satisfactorily.

(Step (VI))

The toner particles obtained in step (V) are optionally washed with water in step (VI). The washing method is not particularly limited. For example, the toner particles are collected as a wet cake from the toner particle dispersion liquid by solid-liquid separation, and the wet cake is washed with water. Alternatively, for example, the toner particles in the toner particle dispersion liquid are deposited, the supernatant is replaced with water, and thereafter, the toner particles are redispersed in water.

(Step (VII))

The toner particle obtained in step (V) is optionally dried in step (VII). A method for drying the toner particles is not particularly limited. Examples of a suitable drying method include methods by using a dryer, such as a spray dryer, a fluidized bed dryer, a vacuum freeze dryer, and a reduced pressure dryer. Of these methods, a spray dryer is preferable because the aggregation of the toner particles is easily reduced or prevented during drying. When a spray dryer is used, then if a dispersion liquid of an external additive, such as silica, is sprayed along with the toner particle dispersion liquid, the external additive can be attached to the surfaces of the toner particles.

(Step (VIII))

The electrostatic charge image development toner produced by using the method of the present disclosure may optionally be a toner including an external additive attached on the surfaces of the toner mother particles. When the toner particles are collected as the toner mother particles by using the above method, in step (VIII) an external additive is attached to the surfaces of the toner mother particles. A method for attaching an external additive to the surfaces of the toner mother particles is not particularly limited. An external additive may be attached to the surfaces of the toner mother particles, for example, as follows. The toner mother particles may be blended with an external additive by using a mixing device, such as a Henschel mixer or a Nauta mixer, under conditions that are adjusted so that the external additive is not embedded in the surface of the toner mother particle.

Examples of a suitable external additive include silica, and metal oxides, such as alumina, titanium oxide, magnesium oxide, zinc oxide, strontium titanate, and barium titanate. These external additives may be used alone or two or more of these external additives may be used in combination. These external additives may be hydrophobidized before use, with the use of a hydrophobizing agent, such as an amino silane coupling agent or silicone oil. If the hydrophobidized external additive is used, the decrease in the amount of charge on the toner at high temperature and high humidity is easily reduced or prevented. Also, good flowability is easily imparted to the toner.

The external additive preferably has a particle size of at least 0.01 μm and not more than 1.0 μm.

The amount of the external additive which is attached to the toner mother particle is preferably at least 1 part by mass and not more than 10 parts by mass with respect to 100 parts by mass of the toner mother particle before the external additive is attached, more preferably at least 2 parts by mass and not more than 5 parts by mass.

<<Non-Core-Shell Toner>>

The toner of the present disclosure may be a non-core-shell toner in which the above-described resin particulates (each including a particulate core and a coating layer of particular materials) are present in both the surface layer of the toner particle and the other portion of the toner particle. In the non-core-shell toner, the resin particulates are used as a binder resin. In the non-core-shell toner, the binder resin may optionally contain a component(s), such as a release agent, a colorant, a charge control agent, and a magnetic powder.

The suitable contents of a release agent, a colorant, a charge control agent, and a magnetic powder in the non-core-shell toner are similar to those of a release agent, a colorant, a charge control agent, and a magnetic powder in the toner core of the core-shell toner.

The non-core-shell toner may be produced by using a pulverization method or an aggregation method. In the pulverization method, after the components of the toner are mixed, the mixture is melt and kneaded, and the resultant melt and kneaded matter is pulverized, followed by classification into the desired particle size. In the aggregation method, after particulates of the components of the toner are caused to aggregate, the aggregated particulates are heated to coalesce the components in the aggregated particulates together. When the toner of the present disclosure is a non-core-shell toner, the toner particle needs to be formed to have the above-described resin particulates in the surface layer, and each of the above-described particulates includes a particulate core and a coating layer of predetermined materials. However, when the toner is produced by the pulverization method by using the resin particulates, the structure of the resin particulate covered by the coating layer is destroyed during the melting and kneading process, and therefore, the use of resin particulates having a particular structure is meaningless. Therefore, the aggregation method is employed to produce a non-core-shell toner as the toner of the present disclosure.

The non-core-shell toner may be produced by using a method similar to that which is used to produce the toner core by using the aggregation method, which has been described above about the core-shell toner. When the non-core-shell toner is produced by using the aggregation method, resin particulates each including a particulate core and a coating layer, and particulates of a resin which can be used as the binder resin of the toner core of the above-described core-shell toner, may be used in combination.

When the above resin particulates, and another resin particulates which can be used as the binder resin of the toner core in the above core-shell toner, are used in combination, the proportion of the mass of the latter resin particulates to the total mass of the former and latter resin particulates is preferably not more than 20% by mass, more preferably not more than 10% by mass, and particularly preferably not more than 5% by mass.

<<Two-Component Developer>>

The toner of the present disclosure may be blended with a desired carrier and the resultant mixture may be used as a two-component developer. When a two-component developer is prepared, a magnetic carrier may be preferably used.

An example of a carrier suitable for an electrostatic latent image development toner which is included in a two-component developer is a carrier which includes a carrier core covered with a resin. Examples of the carrier core include particles of metals, such as iron, oxidized iron, reduced iron, magnetite, copper, silicon steel, ferrite, nickel, and cobalt; particles of alloys of these materials and metals, such as manganese, zinc, and aluminum; particles of iron alloys, such as iron-nickel alloys and iron-cobalt alloys; particles of ceramics, such as titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate; particles of high dielectric constant substances, such as ammonium dihydrogen phosphate, potassium dihydrogen phosphate, and Rochelle salt; and resin carrier cores in which the above magnetic particles are dispersed in a resin.

Examples of the resin covering the carrier core include (meth)acrylic polymers, styrene-based polymers, styrene-(meth)acrylic copolymers, olefin polymers (polyethylene, chlorinated polyethylene, and polypropylene), polyvinyl chloride, polyvinyl acetate, polycarbonate, cellulose resins, polyester resins, unsaturated polyester resins, polyamide resins, polyurethane resins, epoxy resins, silicone resins, fluorine resins (polytetrafluoroethylene, polychlorotrifluoroethylene, and polyvinylidene fluoride), phenol resins, xylene resins, diallylphthalate resins, polyacetal resins, and amino resins. These resins may be used alone or two or more of these resins may be used in combination.

The particle size of the carrier is preferably at least 20 μm and not more than 120 μm, more preferably at least 25 μm and not more than 80 μm. Note that the particle size of the carrier may be measured by using an electron microscope.

When a toner which is produced by using a method of the present disclosure is used as a two-component developer, the content of the toner is preferably at least 3% by mass and not more than 20% by mass with respect to the mass of the two-component developer, more preferably at least 5% by mass and not more than 15% by mass. If the content of the toner in the two-component developer is within such a range, the image density of a formed image can be maintained at an appropriate level. Also, scattering of the toner from a development apparatus can be reduced or prevented, and therefore, contamination by the toner in an image forming apparatus and attachment of the toner to a recording medium, such as transfer paper, can be reduced or prevented.

The above-described electrostatic charge image development toner of the present disclosure can reduce or prevent occurrence of an image defect, such as a color dot and fogging, in a formed image. Even when the electrostatic charge image development toner is stirred in a development unit for a long time, the toner can be charged to the desired charge amount, and therefore, the occurrence of fogging in a formed image can be reduced or prevented. Therefore, the electrostatic charge image development toner of the present disclosure may be suitably used in various image forming apparatuses.

EXAMPLES

The present disclosure will now be described in greater detail by way of example. Note that the present disclosure is not intended to be limited by ranges described in examples below.

First Preparation Example (Preparation of Resin Particulate Dispersion Liquid)

(Resin Particulate Dispersion Liquids A-C)

<(i) Quaternization Reaction Step>

A 2-liter four-necked flask equipped with a stirrer, a condenser, a thermometer, and a glass nitrogen introduction tube was used as a reaction container. Diethylaminoethyl methacrylate and methyl p-toluenesulfonate whose amounts are shown in Table 1 were added to the reaction container which contained, as a solvent, isobuthanol whose amount is shown in Table 1. The reaction container was placed on a heating mantle. Nitrogen gas was introduced through the glass nitrogen introduction tube into the reaction container to fill the reaction container with an inert atmosphere. Next, the temperature inside the reaction container was increased to 80° C. while stirring the resultant mixture at a stirring rate of 200 rpm, and stirring was continued at that temperature for 1 hour to allow a quaternization reaction to proceed.

<(ii) Polymerization Reaction Step>

After the quaternization reaction, styrene and butyl acrylate whose amounts are shown in Table 1 and 12 g of t-butyl peroxy-2-ethylhexanoate (manufactured by Arkema Yoshitomi, Ltd.), which is a peroxide initiator, were added to the reaction container. Next, the temperature inside the reaction container was increased to 95° C. (polymerization temperature), and thereafter, the mixture in the reaction container was stirred at a stirring rate of 200 rpm for 3 hours. Thereafter, another 12 g of t-butyl peroxy-2-ethylhexanoate was added to the reaction container. The mixture in the reaction container was stirred at a stirring rate of 200 rpm for 3 hours to complete the polymerization reaction. As a result, a dispersion liquid of particulates of a styrene-(meth)acrylic resin having a quaternary ammonium salt functional group was obtained. The obtained dispersion liquid was dried by heating under reduced pressure at 140° C. and 10 kPa by using a reduced pressure dryer to remove the solvent from the dispersion liquid of particulates of a styrene-(meth)acrylic resin having a quaternary ammonium salt functional group, thereby obtaining dried matter of a styrene-(meth)acrylic resin having a quaternary ammonium salt functional group. The dried matter was roughly pulverized by using a pulverization device ("Sample Mill SM-1C" manufactured by Hsiangtai Machinary Co., Ltd.) to obtain roughly pulverized matter of the styrene-(meth)acrylic resin having a quaternary ammonium salt functional group whose average particle size was about 10 μm.

<(iii) Particulate Core Dispersing Step>

One hundred grams of the resultant matter roughly pulverized, 1 g of a cationic surfactant ("QUARTAMIN 24P" manufactured by Kao Corporation), and 25 g of a 0.1 N-sodium hydroxide aqueous solution (basic substance) were mixed to obtain a mixture. Ion-exchanged water was added to the obtained mixture to obtain a total amount of 400 g of slurry. The slurry was poured into a pressure-proof round-bottom stainless steel container, followed by shearing and dispersion by using a high-speed shear emulsification device CLEARMIX ("CLM-2.2S" manufactured by M Technique Co., Ltd.) at a rotor rotational speed of 20,000 rpm for 30 minutes while the slurry was heated and pressurized at 140° C. and 0.5 MPa. Thereafter, the slurry was cooled at a cooling rate of 5° C./min until the temperature inside the stainless steel container was 50° C. while stirring was continued at a rotor rotational speed of 15,000 rpm, to obtain an aqueous medium dispersion liquid containing particulate cores.

<(iv) Coating Layer Forming Step>

A 2-liter four-necked flask equipped with a stirrer and a thermometer was used as a reaction container. The above-prepared aqueous medium dispersion liquid containing particulate cores was added to the reaction container. Next, 25 g of methyl methacrylate, 25 g of butyl acrylate, 0.2 g of octyl thioglycolate, 1 g of a cationic surfactant ("QUARTAMIN 24P" manufactured by Kao Corporation), and ion-exchanged water were mixed to obtain a total amount of 100 g of mixed solution. The mixed solution was dropped into the reaction container for 30 minutes while stirring the contents in the reaction container at a stirring rate of 200 rpm. Next, the temperature inside the reaction container was increased to 95° C. (polymerization temperature), and thereafter, stirring was continued at a stirring rate 200 rpm for 2 hours, to form a coating layer on the surface of the particulate core. Thereafter, the temperature inside the reaction container was cooled to room temperature to obtain resin particulate dispersion liquids A to C. The volume average particle size ($D_{50}$) of resin particulates in the resin particulate dispersion liquid, the molar ratio of a quaternary ammonium salt functional group-containing unit derived from diethylaminoethyl methacrylate in a quaternary ammonium salt functional group-containing resin included in the resin particulate, and the solid content concentration of the resin particulate dispersion liquid are shown in Table 1. The volume average particle size ($D_{50}$) of the resin particulates was measured by using a particle size measuring device ("LA-950" manufactured by Horiba, Ltd.).

(Resin Particulate Dispersion Liquid D)

<(ii) Polymerization Reaction Step>

A 2-liter four-necked flask equipped with a stirrer, a condenser, a thermometer, and a nitrogen introduction tube was used as a reaction container. Styrene and butyl acrylate whose amounts are shown in Table 1 and 12 g of t-butyl peroxy-2-ethylhexanoate (manufactured by Arkema Yoshitomi, Ltd.), which is a peroxide initiator, were added to the reaction container containing, as a solvent, isobuthanol whose amount is shown in Table 1. Next, the temperature inside the reaction container was increased to 95° C. (polymerization temperature), and thereafter, the mixture in the reaction container was stirred at a stirring rate of 200 rpm for 3 hours. Thereafter, another 12 g of t-butyl peroxy-2-ethylhexanoate was added to the reaction container. Next, the mixture in the reaction container was stirred at a stirring rate of 200 rpm for 3 hours to complete the polymerization reaction. As a result, a dispersion liquid of particulates of a styrene-(meth)acrylic resin was obtained. The acrylic resin particulate dispersion liquid thus obtained was dried by heating under reduced pressure at 140° C. and 10 kPa by using a reduced pressure dryer to remove the solvent from the acrylic resin particulate dispersion liquid, thereby obtaining dried matter of a styrene-(meth) acrylic resin. The dried matter thus obtained was roughly pulverized by using a pulverization device ("Sample Mill SM-1C" manufactured by Hsiangtai Machinary Co., Ltd.) to obtain roughly pulverized matter of the styrene-(meth)acrylic resin whose average particle size was about 10 μm.

<(iii) Particulate Core Dispersing Step and (iv) Coating Layer Forming Step>

The resultant matter roughly pulverized was used to perform the same particulate core dispersing step as that which was used in preparation of the resin particulate dispersion liquid A, except that an anionic surfactant ("EMAL 0" manufactured by Kao Corporation) was used instead of the cationic surfactant. Thereafter, the same coating layer forming step as that which was used in preparation of the resin particulate dispersion liquid A was performed to obtain a resin particulate dispersion liquid D. The volume average particle size ($D_{50}$) of resin particulates in the resultant resin particulate dispersion liquid and the solid content concentration of the resultant resin particulate dispersion liquid are shown in Table 1.

(Resin Particulate Dispersion Liquid E)

<(i) Quaternization Reaction Step>

The same quaternization reaction step as that which was used in preparation of the resin particulate dispersion liquid A, except that diethylaminoethyl methacrylate and methyl p-toluenesulfonate whose amounts are shown in Table 1 were used, was performed.

<(ii) Polymerization Reaction Step and (iii) Particulate Core Dispersing Step>

The same polymerization reaction step as that which was used in preparation of the resin particulate dispersion liquid A, except that styrene and butylacrylate whose amounts are shown in Table 1 were used, was performed. Thereafter, the same particulate core dispersing step as that which was performed in preparation of the resin particulate dispersion liquid A was performed to obtain a resin particulate dispersion liquid G. The volume average particle size ($D_{50}$) of resin particulates in the resin particulate dispersion liquid G, the molar ratio of a quaternary ammonium salt functional group-containing unit derived from diethylaminoethyl methacrylate in the quaternary ammonium salt functional group-containing resin contained in the resin particulate, and the solid content concentration, are shown in Table 1.

TABLE 1

| Resin particulate dispersion liquid | A | B | C | D | E |
|---|---|---|---|---|---|
| Quaternization reaction step | | | | | |
| Isobutanol [g] | 250 | 200 | 300 | 200 | 250 |
| Diethylaminoethyl methacrylate [g] | 45 | 15 | 75 | — | 30 |
| Methyl p-toluenesulfonate [g] | 45 | 15 | 75 | — | 30 |
| Polymerization reaction step | | | | | |
| Styrene [g] | 156 | 216 | 120 | 246 | 210 |
| Butyl acrylate [g] | 72 | 72 | 48 | 72 | 48 |
| Presence or not of coating layer of resin particulates | Yes | Yes | Yes | No | No |
| Volume average particle size ($D_{50}$) [μm] | 0.12 | 0.17 | 0.12 | 0.20 | 0.13 |
| Ratio of a quaternary ammonium salt functional group-containing unit [mol %] | 20 | 6 | 32 | 0 | 20 |

TABLE 1-continued

| Resin particulate dispersion liquid | A | B | C | D | E |
|---|---|---|---|---|---|
| Solid content concentration [% by mass] | 29.8 | 28.9 | 29.1 | 24.1 | 23.7 |

Second Preparation Example (Preparation of Colorant Particulate Dispersion Liquid A)

Sixty grams of a cationic surfactant ("QUARTAMIN 24P" manufactured by Kao Corporation) was dissolved in 600 g of ion-exchanged water. One hundred grams of a cyan colorant ("copper phthalocyanine CTBX121" manufactured by DIC corporation) was gradually added to the resultant aqueous solution. Next, the resultant aqueous dispersion liquid containing the cyan colorant was emulsified by stirring by using a homogenizer ("ULTRA-TURRAX T50" manufactured by IKA Works, Inc.) at a stirring rate of 2000 rpm for 5 minutes. An emulsifying process was performed five times by using a Gaulin homogenizer ("15M-8TA" manufactured by APV) at 100° C. and 500 kg/cm$^2$. As a result, a colorant particulate dispersion liquid having a solid content concentration of 16.1% by mass was obtained. The colorant particulates in the dispersion liquid had a volume average particle size ($D_{50}$) of 0.21 μm.

(Preparation of Colorant Particulate Dispersion Liquid B)

A colorant particulate dispersion liquid B was obtained by using the same method as that which was used in preparation of the colorant particulate dispersion liquid A, except that 21 g of an anionic surfactant ("EMAL 0" manufactured by Kao Corporation) was used instead of the cationic surfactant. As a result, a colorant particulate dispersion liquid having a solid content concentration of 15.9% by mass was obtained. The colorant particulates in the dispersion liquid had a volume average particle size ($D_{50}$) of 0.22 μm.

Third Preparation Example (Preparation of Release Agent Particulate Dispersion Liquid A)

Two hundred grams of a release agent ("WEP-5" manufactured by NOF Corporation, an ester compound of pentaerythritol and a saturated fatty acid having 14-20 carbon atoms, melting point: 73° C.), 3 g of a cationic surfactant ("QUARTAMIN 24P" manufactured by Kao Corporation), and 800 g of ion-exchanged water were mixed, followed by heating at 100° C., to melt the release agent. Next, the resultant mixed solution of water and the release agent was emulsified by stirring with the use of a homogenizer ("ULTRA-TURRAX T50" manufactured by IKA Works, Inc.) at a stirring rate of 2000 rpm for 5 minutes. An emulsifying process was performed five times by using a Gaulin homogenizer ("15M-8TA" manufactured by APV) at 100° C. and 500 kg/cm$^2$. As a result, a release agent particulate dispersion liquid having a solid content concentration of 20.2% by mass was obtained. The release agent particulates in the dispersion liquid had a volume average particle size ($D_{50}$) of 0.15 μm.

(Preparation of Release Agent Particulate Dispersion Liquid B)

A release agent particulate dispersion liquid B was obtained by using the same method as that which was used in preparation of the release agent particulate dispersion liquid A, except that 1 g of an anionic surfactant ("EMAL 0" manufactured by Kao Corporation) was used instead of the cationic surfactant. As a result, a release agent particulate dispersion liquid having a solid content concentration of 19.7% by mass was obtained. The release agent particulates in the dispersion liquid had a volume average particle size ($D_{50}$) of 0.15 μm.

Fourth Preparation Example (Preparation of Silica)

One hundred grams of dimethylpolysiloxane (manufactured by Shin-Etsu Chemical Co., Ltd.) and 100 g of 3-aminopropyltrimethoxysilane (manufactured by Shin-Etsu Chemical Co., Ltd.) were dissolved in 200 g of toluene, followed by diluting the solution by a factor of 10. Next, the diluted solution of dimethylpolysiloxane and 3-aminopropyltrimethoxysilane was gradually dropped to 200 of fumed silica AEROSIL #90 (manufactured by Nippon Aerosil) while stirring, followed by ultrasonic irradiation and stirring (mixing) for 30 min. The resultant mixture was heated in a thermostat bath at 150° C., followed by removal of toluene by using a rotary evaporator, to obtain solid matter. The solid matter was further dried by using a reduced pressure dryer until constant weight at a set temperature of 50° C. Moreover, the solid matter was dried by using an electric furnace under nitrogen gas flow at 200° C. for 3 hours. The dried solid matter was processed to obtain a rough silica powder. The rough silica powder was further pulverized by using a jet mill ("IDS Jet Mill" manufactured by Nippon Pneumatic MFG Co., Ltd.), and the resultant powder was collected by using a bag filter, to obtain silica.

Examples 1-3 and Comparative Example 2

<Aggregating Step>

Three hundred twenty grams of resin particulate dispersion liquids shown in Tables 2 and 4, 90 g of the release agent particulate dispersion liquid A, 40 g of the colorant particulate dispersion liquid A, 100 g of an aqueous surfactant solution A described below, and 500 g of distilled water were added to a 2-liter round-bottom flask of stainless steel. Next, 1 g of a 1 N-sodium hydroxide aqueous solution was added to the mixture in the flask to adjust the pH of the mixture to 8 while stirring the mixture by using a stir blade at a stirring rate of 100 rpm at 25° C. The pH-adjusted mixture in the flask was stirred at a stirring rate of 100 rpm at 25° C. for 10 minutes, and thereafter, 39 g of an aggregating agent (a mixed solution of magnesium chloride and water, specifically, an aqueous solution containing 50% by mass of magnesium chloride) was added to the flask for 5 min. After the aggregating agent was added, the temperature inside the flask was increased at a temperature increase rate of 0.2° C./min while stirring the mixture in the flask at a stirring rate of 200 rpm. The volume average particle size of aggregated particulates contained in the mixture in the flask during the increasing of the temperature was measured by using a particle-size distribution measuring device ("Multisizer 3" manufactured by Beckman Coulter, Inc), and the increasing of the temperature was then stopped when the volume average particle size of the aggregated particulates reached 4.5 μm. The temperature at which the increasing of the temperature was stopped was in the vicinity of 48° C. Aqueous surfactant solution A: aqueous cationic surfactant ("QUARTAMIN 24P" manufactured by Kao Corporation) solution (concentration: 10% by mass)

<Coalescing Step>

After the aggregating step, the temperature inside the flask was increased to 55° C. at a temperature increase rate of 0.2° C./min while stirring the aggregated particulate dispersion liquid in the flask by using a stirring blade at a stirring rate of 200 rpm. After the increasing of the temperature, the mixture in the flask was stirred at that temperature for 60 minutes to coalesce the aggregated particulates together, thereby obtaining an aqueous medium dispersion liquid containing toner mother particles. The toner mother particles in the aqueous medium had an average circularity of 0.955. Note that the average circularity was measured by using a particle shape and particle size measuring device ("FPIA3000" manufactured by Sysmex Corporation).

<Washing Step>

The aqueous medium dispersion liquid containing toner mother particles was filtered by suction to obtain a wet cake of the toner mother particles. Next, the wet cake was redispersed in ion-exchanged water to wash the toner mother particles. A similar washing process was performed five times to wash the toner mother particles, to obtain a wet cake of the toner mother particles.

<Drying Step>

The wet cake of the toner mother particles was dispersed in an aqueous ethanol solution having a concentration of 50% by mass to obtain a slurry. The slurry was dried by using a continuous surface improving device ("Coatmizer" manufactured by Freund Corporation) at a hot air temperature of 40° C. and an air blow rate of 2 $m^3$/min for 72 hours, to obtain the toner mother particles.

<External Additive Attaching Step>

One hundred grams of the resultant toner mother particles and the silica obtained in the fifth preparation example were mixed by using a Henschel mixer (manufactured by Nippon Coke & Engineering. Co., Ltd., volume: 5 L) for 5 minutes. Thereafter, the mixture was sieved by using a sieve (#300 mesh, mesh opening: 48 μm) to obtain toners of Examples 1-3 and Comparative Example 2.

Examples 4-7 and Comparative Examples 1 and 3

<Aggregating Step>

The same aggregating step as that of Example 1 was performed, except that the resin particulate dispersion liquids were replaced with those shown in Tables 2-4, the release agent particulate dispersion liquid was replaced with the release agent particulate dispersion liquid B, the colorant particulate dispersion liquid was replaced with the colorant particulate dispersion liquid B, and the aqueous surfactant solution was replaced with 50 g of an aqueous surfactant solution B described below. The temperature at which the volume average particle size of aggregated particulates reached 4.5 μm was in the vicinity of 46° C.

Aqueous surfactant solution B: aqueous anionic surfactant ("EMAL 0" manufactured by Kao Corporation) solution (concentration: 25% by mass)

<Coalescing Step>

After the aggregating step, the temperature inside the flask was increased to 54° C. at a temperature increase rate of 0.2° C./min while stirring the aggregated particulate dispersion liquid in the flask by using a stirring blade at an increased stirring rate of 200 rpm. Next, the temperature inside the flask was increased to 55° C., followed by stirring of the mixture in the flask at that temperature for 60 minutes to coalesce the aggregated particulates together, thereby obtaining an aqueous medium dispersion liquid containing toner cores. The toner cores in the aqueous medium had an average circularity of 0.953.

<Mixing Step>

After the coalescing step, a 2 N-chloric acid aqueous solution was added to the aqueous medium dispersion liquid containing the toner cores in the flask while stirring by using a stirring blade at a stirring rate of 100 rpm, to adjust the aqueous medium dispersion liquid containing the toner cores to a pH of 4.5. Next, 160 g of resin particulate dispersion liquids shown in Tables 2-4 was added to the flask. Thereafter, the mixture in the flask was stirred for 15 minutes to obtain an aqueous medium dispersion liquid containing the toner cores and resin particulates.

<Covering/Film Forming Step>

A 1 N-sodium hydroxide aqueous solution was added to the aqueous medium dispersion liquid containing the toner cores and the resin particulates which was obtained in the mixing step to adjust the dispersion liquid to a pH of 7. Next, the temperature inside the flask was increased to 55° C. at a temperature increase rate of 0.2° C./min Thereafter, the temperature inside the flask was increased to 60° C., and the mixture in the flask was stirred at that temperature for 120 minutes. The toner core was covered with the resin particulates, which were then caused to form a film, i.e., a shell layer on the surface of the toner core. Thereafter, the mixture in the flask was cooled to 25° C. at a cooling rate of 10° C./min to obtain an aqueous medium dispersion liquid containing toner mother particles.

<Washing Step, Drying Step, and External Additive Attaching Step>

Thereafter, a washing step, a drying step, and an external additive attaching step similar to those of Example 1 were performed on the aqueous medium dispersion liquid containing the resultant toner mother particles to obtain toners of Examples 4-7 and Comparative Examples 1 and 3.

<<Evaluation>>

The toners of Examples 1-7 and Comparative Examples 1-3 were evaluated in terms of initial image defect, chargeability, and image fogging by using a method described below. The evaluations in terms of initial image defect, chargeability, and image fogging were conducted by using a color multifunctional peripheral ("TASKalfa 550ci" manufactured by Kyocera Document Solutions Inc.). Plain paper was used as a recording medium. Note that the evaluations in terms of initial image defect, chargeability, and image fogging were performed by using a two-component developer which was prepared by a method described below. The results of the evaluation of the toners of Examples 1-7 and Comparative Examples 1-3 are shown in Tables 2-4.

Fifth Preparation Example (Preparation of Carrier)

Thirty grams of a polyamide-imide resin was diluted with 2 L of water to obtain a diluted solution. One hundred twenty grams of an ethylene tetrafluoride-propylene hexafluoride copolymer (FEP) was dispersed in the diluted solution, and then 3 g of silicon oxide was dispersed to obtain a coating layer formation solution. The obtained coating layer formation solution and 10 kg of a non-coated ferrite carrier core ("EF-35B" manufactured by Powdertech Co., Ltd., average particle size: 35 μm) were added to a fluidized bed coating device to coat the carrier core. Thereafter, baking was performed at 250° C. for 1 hour to obtain a carrier.

(Mixing of Toner and Carrier)

The resultant resin-coated ferrite carrier, and the toners of Examples 1-7 and Comparative Examples 1-3, were added to a 500-ml polyethylene bottle in amounts which would provide a two-component developer having a toner concentration of 10% by mass, followed by mixing with the use of a tumbler mixer ("T2F" manufactured by Shinmaru Enterprises Corporation) for 30 minutes, to prepare a two-component developer.

<Method for Evaluation of Initial Image Defect>

A total of four color toners, i.e., the prepared cyan toner and three other color toners for a color multifunctional peripheral ("TASKalfa 550ci" manufactured by Kyocera Document Solutions Inc.), were used to form a test pattern by using the color multifunctional peripheral ("TASKalfa 550ci" manufactured by Kyocera Document Solutions Inc.). The formed test pattern was visually examined to find out the presence or absence of a color dot and fogging. An initial image defect was evaluated by using the following criteria.

OK: neither of a color dot and fogging was observed on an image

NG: a color dot or fogging was observed on an image

<Method for Evaluation of Chargeability>

The prepared cyan toner and two-component developer were used to form a test character pattern by using the color multifunctional peripheral under environmental conditions of 20° C. and 65% RH, where the character pattern formation was successively performed on 5000 sheets of paper at a printing rate of 2%. After the image formation was performed on 5000 sheets of paper, a patch pattern was successively formed on 1000 sheets of paper at a printing rate of 50%. The charge amount ($Q_1$) of toner after the 5000-sheet successive image formation and the charge amount ($Q_2$) of toner after the 1000-sheet successive image formation were measured by using a charge amount measuring device. A variation ($|Q_2-Q_1|$) of the toner charge amounts ($Q_1$ and $Q_2$) was calculated. The chargeability was evaluated by using the following criteria. Note that "OK" and "Normal" are acceptable.

OK: $|Q_2-Q_1|$ is less than 2 μC/g

Normal: $|Q_2-Q_1|$ is at least 2 μC/g and less than 5 μC/g

NG: $|Q_2-Q_1|$ is at least 5 μC/g

<Method for Evaluation of Image Fogging>

A total of four color toners, i.e., the prepared cyan toner and two-component developer and three other color toners for a color multifunctional peripheral ("TASKalfa 550ci" manufactured by Kyocera Document Solutions Inc.) and a two-component developer for respective other color toners were used to form a test color character pattern by using the color multifunctional peripheral under environmental conditions of 20° C. and 65% RH, where the character pattern formation was successively performed on 5000 sheets of paper at a printing rate of 2%. After the image formation was performed on 5000 sheets of paper, a color patch pattern was successively formed on 1000 sheets of paper at a printing rate of 50%. A value obtained by subtracting the image density of blank paper before printing an image from the image density of a blank portion of a patch pattern was defined as a fogging density. An image fogging was evaluated by using the following criteria. Note that "OK" and "Normal" are acceptable.

OK: the fogging density is less than 0.004

Normal: the fogging density is at least 0.004 and less than 0.010

NG: the fogging density is at least 0.010

TABLE 2

| Example | 1 | 2 | 3 | 4 |
|---|---|---|---|---|
| Type of resin particulate dispersion liquid | | | | |
| (I) Aggregating step | A | B | C | D |
| (III) Mixing step | — | — | — | A |
| Evaluation result | | | | |
| Initial image defect | OK | OK | OK | OK |

TABLE 2-continued

| Example | 1 | 2 | 3 | 4 |
|---|---|---|---|---|
| Chargeability | | | | |
| $Q_1$ [μC/g] | 25.6 | 19.5 | 33.7 | 23.6 |
| $Q_2$ [μC/g] | 24.9 | 20.1 | 32.1 | 22.7 |
| $\lvert Q_2 - Q_1 \rvert$ [μC/g] | 0.7 | 0.6 | 1.6 | 0.9 |
| Evaluation | OK | OK | OK | OK |
| Image fogging | | | | |
| Fogging density | 0.004 | 0.006 | 0.003 | 0.004 |
| Evaluation | OK | OK | OK | OK |

TABLE 3

| Example | 5 | 6 | 7 |
|---|---|---|---|
| Type of resin particulate dispersion liquid | | | |
| (I) Aggregating step | D | D | A |
| (III) Mixing step | C | A | C |
| Evaluation result | | | |
| Initial image defect | OK | OK | OK |
| Chargeability | | | |
| $Q_1$ [μC/g] | 25.1 | 19.3 | 31.9 |
| $Q_2$ [μC/g] | 24.4 | 19.7 | 30.7 |
| $\lvert Q_2 - Q_1 \rvert$ [μC/g] | 0.7 | 0.4 | 1.2 |
| Evaluation | OK | OK | OK |
| Image fogging | | | |
| Fogging density | 0.003 | 0.005 | 0.002 |
| Evaluation | OK | OK | OK |

TABLE 4

| Comparative Example | 1 | 2 | 3 |
|---|---|---|---|
| Type of resin particulate dispersion liquid | | | |
| (I) Aggregating step | A | E | D |
| (III) Mixing step | E | — | E |
| Evaluation result | | | |
| Initial image defect | NG | NG | NG |
| Chargeability | | | |
| $Q_1$ [μC/g] | 27.1 | 19.5 | 17.1 |
| $Q_2$ [μC/g] | 25.4 | 16.4 | 14.5 |
| $\lvert Q_2 - Q_1 \rvert$ [μC/g] | 1.7 | 3.1 | 2.6 |
| Evaluation | OK | NG | NG |
| Image fogging | | | |
| Fogging density | 0.005 | 0.013 | 0.011 |
| Evaluation | OK | NG | NG |

As shown in Examples 1-7, the surface layer of a toner particle in an electrostatic charge image development toner is made from resin particulates each including a particulate core containing a quaternary ammonium salt functional group-containing resin and a coating layer covering the particulate core which contains one or more resins selected from the group consisting of (meth)acrylic resins and styrene-(meth) acrylic resins. If an electrostatic charge image development toner containing such resin particulates is used, image defects, such as a color dot and fogging, can be reduced or prevented in a formed image, and even if the toner is stirred in a development unit for a long time, the toner can be charged to the desired charge amount.

In Comparative Example 1, a shell layer which is the surface layer of a toner particle is made from resin particulates each including a particulate core containing a quaternary ammonium salt functional group-containing resin which is not covered by a coating layer. The toner core described above is made from resin particulates each including a particulate core containing a quaternary ammonium salt functional group-containing resin and a coating layer covering the particulate core which contains one or more resins selected from the group consisting of (meth)acrylic resins and styrene-(meth)acrylic resins. If the electrostatic charge image development toner containing such resin particulates is used, then when an image is formed, image defects, such as a color dot and fogging, are likely to occur in the formed image.

In Comparative Example 2, an electrostatic charge image development toner is made from toner particles including resin particulates in which a particulate core containing a quaternary ammonium salt functional group-containing resin is not covered by a coating layer. If the electrostatic charge image development toner containing such resin particulates is used, image defects, such as a color dot and fogging, are likely to occur in an formed image, and when the toner is stirred in a development unit for a long time, the toner cannot be charged to the desired charge amount, and therefore, fogging is likely to occur.

In Comparative Example 3, a shell layer which is the surface layer of a toner particle is made from resin particulates in which a particulate core containing a quaternary ammonium salt functional group-containing resin is not covered by a coating layer. Also, the toner core is formed by using a styrene-(meth)acrylic resin which does not contain a quaternary ammonium salt functional group as a binder resin. If an electrostatic charge image development toner containing such resin particulates is used, image defects, such as a color dot and fogging, are likely to occur in an formed image, and when the toner is stirred in a development unit for a long time, the toner cannot be charged to the desired charge amount, and therefore, fogging is likely to occur.

What is claimed is:

1. An electrostatic charge image development toner containing a plurality of toner particles, wherein the plurality of toner particles are each formed to have resin particulates in a surface layer, the resin particulates each include a particulate core and a coating layer covering the particulate core, the particulate core contains a quaternary ammonium salt functional group-containing resin, and the coating layer contains one or more resins selected from the group consisting of (meth)acrylic resins and styrene-(meth)acrylic resins.

2. An electrostatic charge image development toner according to claim 1, wherein each of the toner particles includes a toner core containing a binder resin and a shell layer covering the toner core.

3. An electrostatic charge image development toner according to claim 2, wherein the toner core is formed by causing particulates containing the binder resin to aggregate in an aqueous medium to form aggregated particulates, and heating the aggregated particulates in the aqueous medium to coalesce components included in the aggregated particulates together.

4. An electrostatic charge image development toner according to claim 1, wherein the electrostatic charge image development toner is formed by causing the resin particulates to aggregate in an aqueous medium to form aggregated particulates, and heating the aggregated particulates in the aqueous medium to coalesce components included in the aggregated particulates together.

5. An electrostatic charge image development toner according to claim 1, wherein the molar ratio of a unit derived from a monomer having the quaternary ammonium salt functional group to all units included in the quaternary ammonium salt functional group-containing resin is at least 5 mol % and not more than 35 mol %.

6. An electrostatic charge image development toner according to claim 1, wherein the quaternary ammonium salt functional group-containing resin has a melting point of at least 80° C. and not more than 150° C.

7. An electrostatic charge image development toner according to claim 1, wherein the quaternary ammonium salt functional group-containing resin has a glass transition point of at least 40° C. and not more than 80° C.

8. An electrostatic charge image development toner according to claim 1, wherein the resin particulates have a volume average particle size of at least 0.03 μm and not more than 0.50 μm.

9. An electrostatic charge image development toner according to claim 2, wherein the binder resin has a softening point of at least 60° C. and not more than 100° C.

* * * * *